US007243816B2

(12) United States Patent
Aochi

(10) Patent No.: US 7,243,816 B2
(45) Date of Patent: Jul. 17, 2007

(54) CONTAINER WITH ONE-PIECE SEAL AND LID SPRING

(75) Inventor: Yasumitsu Aochi, Tokyo (JP)

(73) Assignee: Dart Industries Inc., Orlando, FL (US)

( * ) Notice: Subject to any disclaimer, the term of this patent is extended or adjusted under 35 U.S.C. 154(b) by 320 days.

(21) Appl. No.: 10/365,902

(22) Filed: Feb. 13, 2003

(65) Prior Publication Data

US 2004/0159661 A1 Aug. 19, 2004

(51) Int. Cl.
*B65D 43/22* (2006.01)
*B65D 53/02* (2006.01)
*B65D 25/10* (2006.01)

(52) U.S. Cl. ..... 220/829; 220/264; 220/378; 220/759; 220/849; 220/835

(58) Field of Classification Search ..... 220/264, 220/835, 829, 849, 759, 838, 827, 378, 254.5; 215/235
See application file for complete search history.

(56) References Cited

U.S. PATENT DOCUMENTS 2,483,304 A * 9/1949 Vogel ..... 220/324
4,454,889 A * 6/1984 Contreras, Sr. ..... 132/301
4,643,326 A 2/1987 Klingler
4,711,360 A 12/1987 Ullman
4,842,158 A 6/1989 Reyes, Jr.
5,170,533 A 12/1992 Barry
5,203,471 A 4/1993 Widman
5,289,930 A 3/1994 Inouye
5,344,037 A 9/1994 Favre
5,494,185 A 2/1996 Dubach
5,501,348 A 3/1996 Takeuchi
5,573,127 A 11/1996 Takahashi et al.
5,620,107 A 4/1997 Takeuchi
5,669,522 A 9/1997 Million et al.
5,699,912 A 12/1997 Ishikawa et al.
5,703,734 A * 12/1997 Berberich et al. ..... 360/97.02
5,762,216 A 6/1998 Takeuchi
5,769,253 A 6/1998 Gross (Continued)

FOREIGN PATENT DOCUMENTS

JP 47-8555 10/1972

(Continued)

OTHER PUBLICATIONS

Merries Bay Wipes, Japan, date not known.

(Continued)

*Primary Examiner*—Anthony D. Stashick
*Assistant Examiner*—James Smalley

(57) ABSTRACT

A container including a container body with a pivotally mounted top lid utilizing a single generally planar elastomeric member forming a seal section releasably mounted to the undersurface of the lid and engageable with the rim of the container body peripherally thereabout, and a spring section integral with the seal section and extending from the lid into a receiving chamber on the container body adjacent the pivotal mounting of the lid, the spring section being resiliently compressed during the positioning thereof to provide a constant opening biasing force on the lid relative to the container body. An alternately positionable handle is removably mounted, at the option of the user, to either the front wall or the rear wall of the container body.

17 Claims, 8 Drawing Sheets

U.S. PATENT DOCUMENTS

| | | | | |
|---|---|---|---|---|
| 5,788,064 | A | 8/1998 | Sacherer et al. | |
| 5,845,803 | A * | 12/1998 | Saito et al. | 220/378 |
| 5,868,265 | A | 2/1999 | Kobayashi | |
| 5,926,027 | A | 7/1999 | Bumb, Jr. et al. | |
| 6,032,817 | A | 3/2000 | Ejima et al. | |
| 6,037,872 | A | 3/2000 | Dunnum | |
| 6,170,683 | B1 | 1/2001 | Montgomery | |
| 6,206,221 | B1 | 3/2001 | Bando et al. | |
| 6,257,431 | B1 * | 7/2001 | Baudin | 215/237 |
| 6,283,298 | B1 | 9/2001 | Seidler | |
| 6,364,152 | B1 | 4/2002 | Poslinski et al. | |
| 2003/0178428 | A1 * | 9/2003 | Chang | 220/378 |

FOREIGN PATENT DOCUMENTS

| | | |
|---|---|---|
| JP | 51-35319 | 8/1976 |
| JP | 53-31667 | 8/1978 |
| JP | 57-7368 | 2/1982 |
| JP | 63-88965 | 6/1988 |
| JP | 63-46002 | 11/1988 |
| JP | 2-10248 | 1/1990 |
| JP | 3-111960 | 11/1991 |
| JP | 5-2458 | 1/1993 |
| JP | 5-32451 | 8/1993 |
| JP | 6-56011 | 8/1994 |
| JP | 3 038031 | 3/1997 |
| JP | 9-58725 | 3/1997 |
| JP | 9315453 | 12/1997 |
| JP | 10329878 | 12/1998 |
| JP | 11-49207 | 2/1999 |
| JP | 11-115956 | 4/1999 |
| JP | 11-115974 | 4/1999 |
| JP | 11-180460 | 7/1999 |
| JP | 11-193044 | 7/1999 |
| JP | 2991277 | 10/1999 |
| JP | 2000-25805 | 1/2000 |
| JP | 200085814 | 3/2000 |
| JP | 2000211661 | 8/2000 |
| JP | 3105890 | 9/2000 |
| JP | 3202662 | 6/2001 |

OTHER PUBLICATIONS

Pigeon, Japan, date not known.
Pigeon Wet Wipes, Japan, date not known.

* cited by examiner

FIG.1
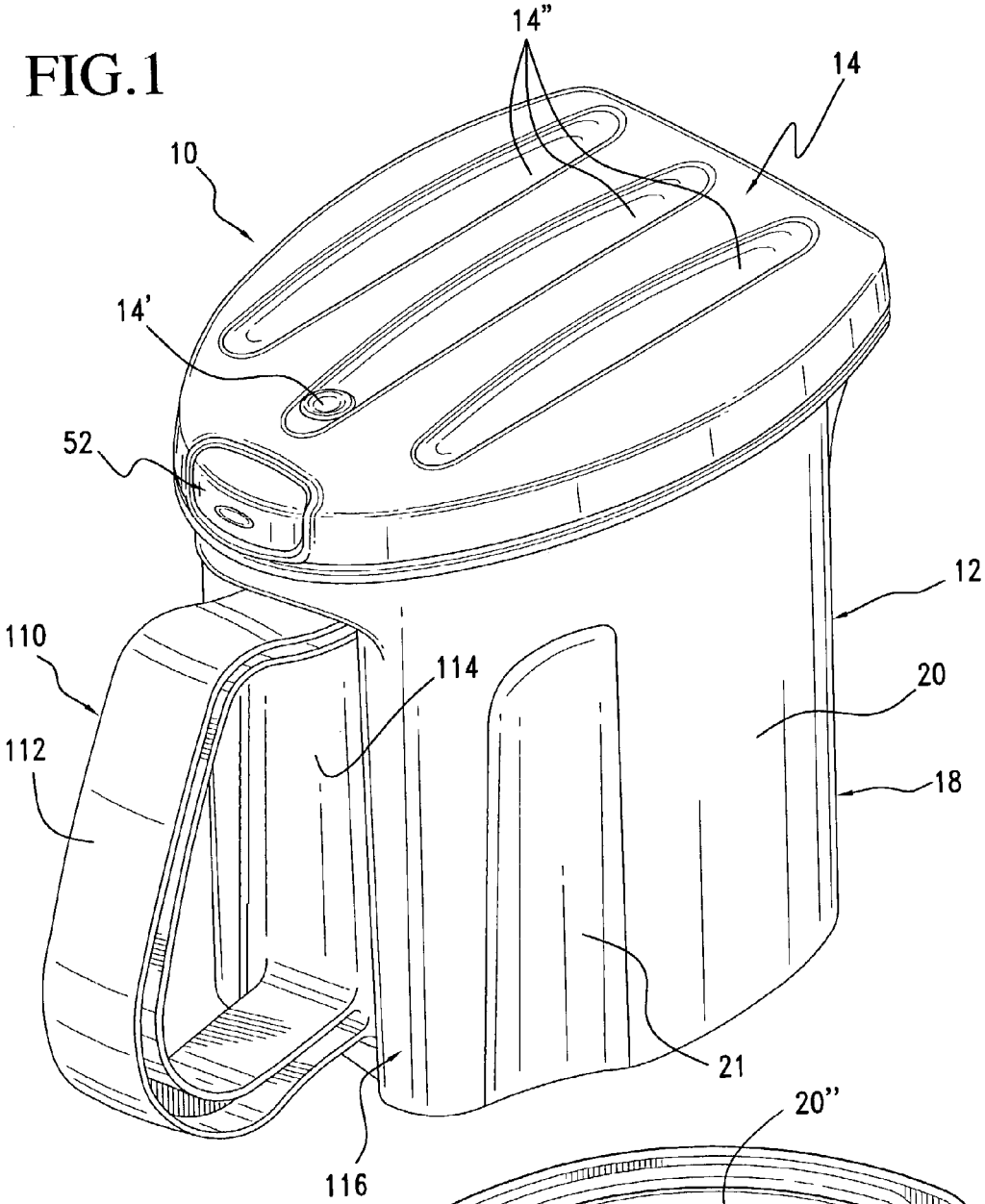
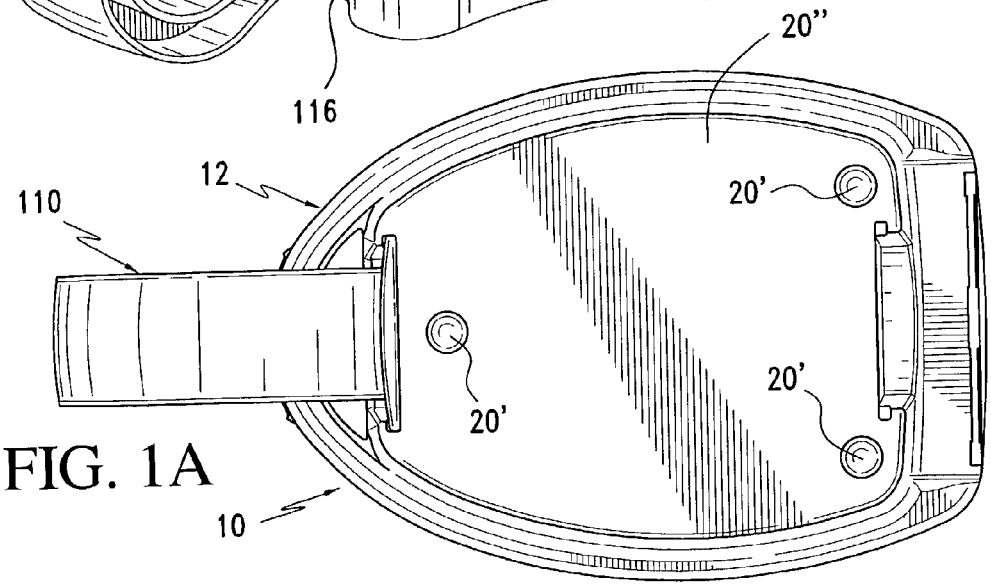
FIG. 1A 80
82
84
86
88
94
96
97
98
100
8
8

88
90
92
86
100
92
90
97

CONTAINER WITH ONE-PIECE SEAL AND LID SPRING

BACKGROUND OF THE INVENTION

The present invention relates to containers of the type including a container body with an open mouth selectively closed by a spring biased pivotally mounted lid, and more particularly to such containers wherein a seal is provided between the lid and the rim defining the mouth of the container body.

Such seals are normally of an appropriate compressible elastomeric material and, inherently due to the elastomeric nature of the seal, tend to slightly move the lid toward an open position upon release of the normally provided lid latch. One example of such a seal will be noted in U.S. Pat. No. 5,788,064 to Sacherer et al which refers to the partial opening of the lid to be followed by a manual opening of the lid to its fully opened position. The prior art also includes many examples of lidded containers wherein the lid, upon release of an appropriate latch, automatically fully or substantially fully moves to an open position by spring action. Such an opening force has normally heretofore relied upon metal springs of various types, including leaf or compression springs, torsion springs, and the like.

As a variation and improvement on conventional metal springs, it has, recently, been proposed to use elastically deformable springs such as rubber. Two examples of such usage will be found in U.S. Pat. No. 5,344,037 to Favre, and U.S. Pat. No. 6,206,221 B1 to Bando et al.

Another feature known in the prior art which has a bearing on the present invention is the expedient of providing the container body with a removable handle which may be accommodated in one or more positions about the container body. Note as an example U.S. Pat. No. 6,037,872 to Dunnum. Also note the detachable handle per se disclosed in U.S. Pat. No. 5,170,533 to Berry.

SUMMARY OF THE INVENTION

It is the principal intention of the present invention to advance the art in a significant manner, particularly with regard to those features referred to above as broadly known in the prior art. In doing so, it is intended that containers in accord with the present invention will enhance the seal effect commonly sought, provide a practical and highly efficient spring action to the lid, and provide a reversible handle particularly adopted to the container both with regard to the ease of handling the container and to enable manipulation of the container lid in accord with the desires of the particular user. All of goals of the invention are achieved while at the same time providing for particular economies in manufacture and assembly, specifically with regard to the seal and spring which are uniquely although rather simply formed as a single substantially planar member or panel easily accommodated to both the lid and the container body, and, in conjunction therewith, easily replaceable by the end user.

With more specific reference to the container of the invention, the container body, in defining an interior receiving chamber, includes a rear wall or wall portion and an opposed front wall or front wall portion. A complimentary lid engages over the upwardly opening mouth of the container body and is pivotally joined to the rear wall by appropriate hinge means. Appropriate latch means on the container body front wall and cooperating front end of the lid act to selectively retain the lid in the closed position thereof.

Substantially duplicate vertical slots are defined in the front and rear walls of the container body for the selective reception of a container handle in accord with the preference of the user of the container. As an example, should the user wish the convenience of releasing the lid latch with the same hand engaging the handle, the handle will mount to the forward wall. Should the user wish to hold the container by one hand and release the latch with the other hand, the handle will mount to the rear wall. Depending upon the nature of the contents of the container, this will also enable the user to conveniently discharge the contents by a pouring thereof from the front of the container.

A particularly unique aspect of the invention is the utilization of a single sheet or member of elastomeric material, such as for example silicone, in forming both a seal for effectively sealing the container upon a closing of the lid, and a spring which, upon release of the latch, effects an automatic opening of the lid pivotally away from the container. The seal section or seal of the member or panel is configured to conform to and be coextensive with the rim defining the mouth of the container body. The seal will include inner and outer peripheral edges generally parallel to each other. This seal, as illustrated, is of what might be considered an oblong configuration with opposed truncated ends to conform to the similarly configured container body mouth. Were the container of a more conventional cylindrical configuration, the seal or seal section of the elastomeric member would be annular.

At that portion of the seal conforming to the rear of the container body, the elastomeric member extends rearward of the seal section in the manner of a planar extension and defines the spring or spring section. Extending integral from the inner periphery of the seal in alignment with the spring section of the member is an anchoring tongue of a width approximately that of the spring.

The elastomeric member mounts to the undersurface or bottom surface of the lid and is retained by a combination of depending ribs and undercut lugs which engage the inner periphery of the seal. The spring extends, upon mounting, laterally from the seal and engages within a spring pocket provided immediately adjacent and inward of the cooperating hinge components on the rear container body wall and the depending lid skirt. The anchoring tongue is retained in intimate engagement with the bottom surface of the lid by a series of sockets defined in the elastomeric tongue and engaged over a corresponding number of stubs depending from the bottom surface. The elastomeric member or panel is both easily removed and readily mounted by the end user for replacement and cleaning as desired. The lateral positioning of the spring to engage within the spring pocket effects a compression of the spring which results in a resilient biasing tending to return the member to its planar position. This in turn continuously biases the lid to its open position away from the container body mouth. This biasing force is substantially increased in the closed position of the lid wherein maximum compression is achieved. Thus, upon a release of the latch means, the lid will rather rapidly, and in fact with a snapping action, move to its fully opened position and will be automatically retained in the fully open position in that the spring remains under compression, although to a lesser degree than with regard to the fully closed lid. The formation of both the seal and the spring utilizing a single planar elastomeric member or panel has been found to be both practical and economical, and has resulted in a particularly effective seal and spring action with the unique simplicity thereof providing for an interchangeability of both components simultaneously and in a manner easily effected by the ultimate user of the product.

Other features, objects and advantages of the invention will become apparent to those skilled in the art from the following more detailed description of the invention.

BRIEF DESCRIPTION OF THE DRAWINGS

Attention is now directed to the drawings wherein like reference numerals refer to like parts throughout the several views and wherein:

FIG. 1 is a perspective view of the closed container with the handle mounted on the front wall.

FIG. 1A is a bottom plan view, in reduced scale, of the container.

DESCRIPTION OF PREFERRED EMBODIMENTS

Figure 2:
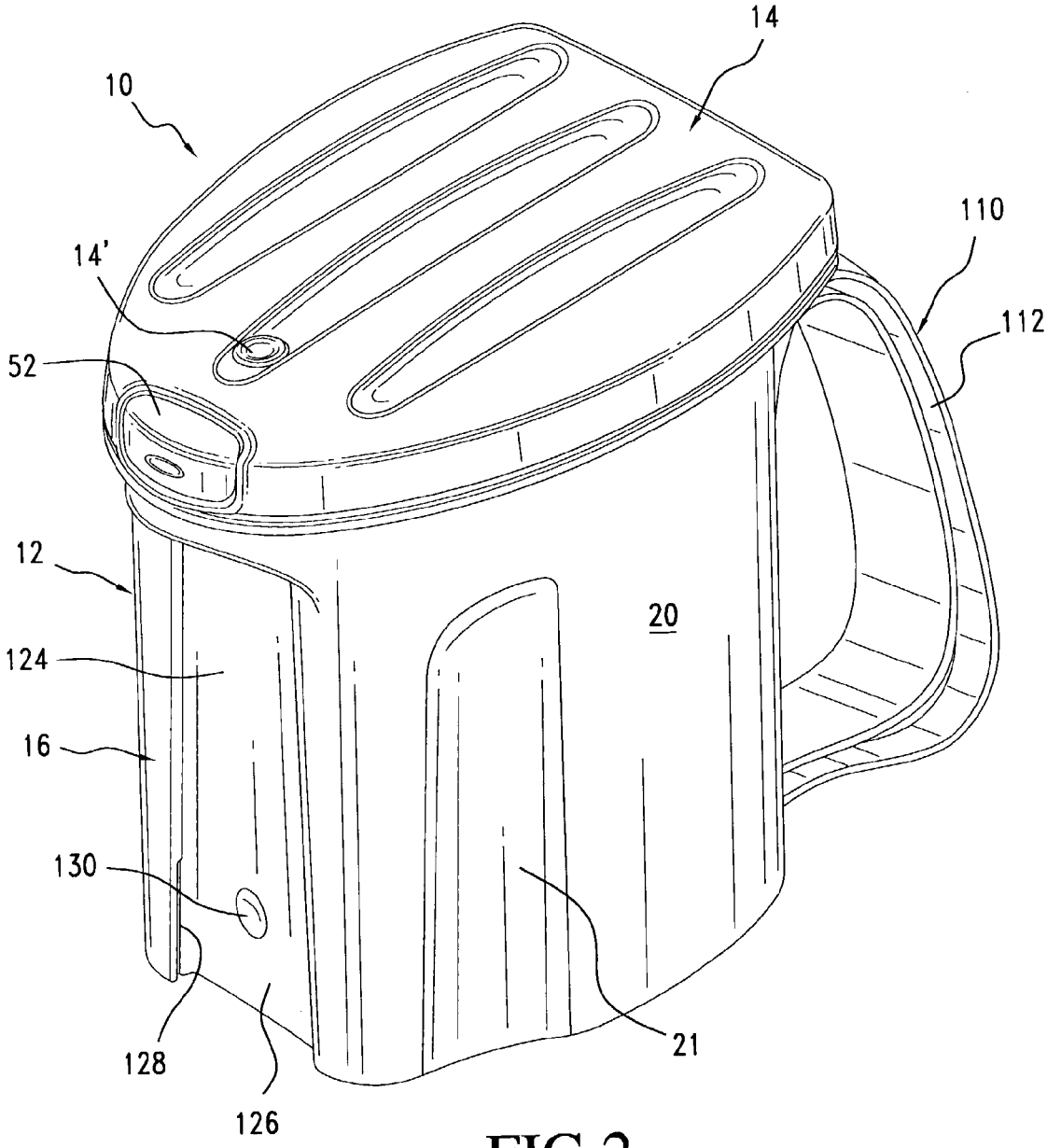
FIG. 2 is a perspective view of the closed container with the handle mounted on the rear wall.

Referring now more specifically to the drawings, the container 10 includes an upright container body 12 and a container lid 14. While not limited thereto, the container body 12 has been illustrated as of a generally oval cross section with flat front and rear walls 16 and 18 which, in conjunction with slightly arcuate opposed side walls 20, terminate in a continuous upper edge or rim 22 defining the open mouth of the body 12. Side walls 20, as best appreciated from FIGS. 1 and 5, are provided with opposed hand grip depressions 21, which may if desired be molded of transparent or translucent resin to allow the contents of the container to be seen.

The lid 14 pivotally mounts to the container body 12 by cooperating pivot means or hinge components provided on the body and lid. More specifically, the rear wall 18 of the body 12 includes an integral rearwardly extending abutment or enlargement downwardly spaced although closely adjacent to the upper mouth-defining rim 22. The upper portion of the abutment is rearwardly spaced from the rear surface of the rear wall to define a full width pocket 26 centrally divided by a vertical divider 28 integral with and projecting outward from the rear wall 18. The abutment 24, outward of the pocket 26, includes a pair of outwardly curving hinge knuckles 30, one to each side of the divider 28 and defining restricted access slots 32 for the snap-in reception of a complementary hinge pin 34 integrally formed with depending ears 36 and a central pin stabilizer 38 which in turn integrally depend from a peripheral lid skirt 40. Noting FIG. 9 in particular, it will be seen that, in the closed position of the lid, the rear portion of the lid skirt 40 and the engaged hinge components define a compartment or pocket extension 42 forming a continuous vertical chamber with the pocket 26 therebelow.

Figure 5:
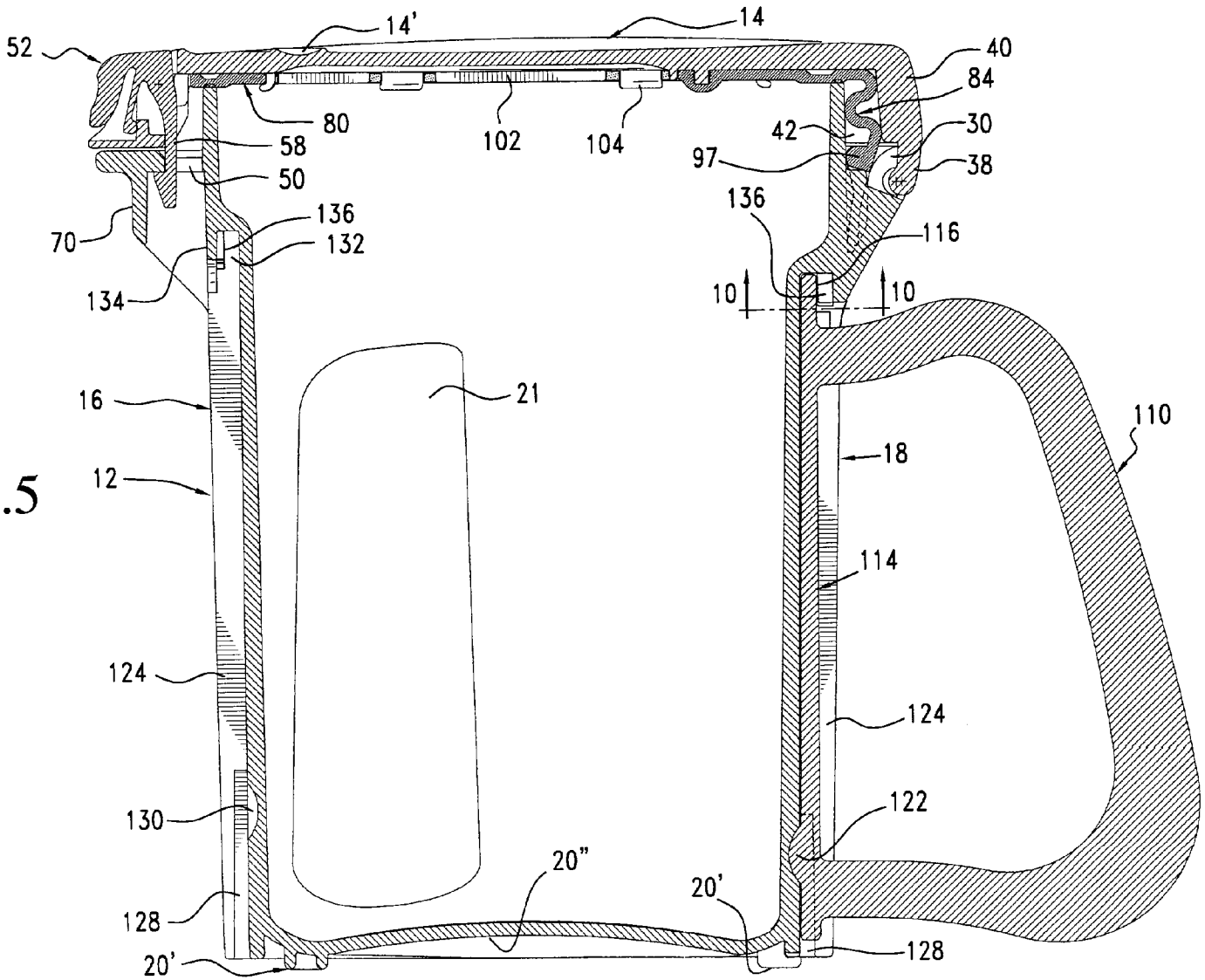
FIG. 5 is an enlarged vertical cross-section view through the container of FIG. 2.

The lid 14 and the container body 12 are preferably provided with stacking means comprising a divot, or indentation 14', elongated depressions 14" in lid 14, which in use cooperate with feet 20', three in number, for example, see FIGS. 1A and 5 on a bottom wall portion 20" of body 12 of another container 10 being stacked thereon.

Figure 6:
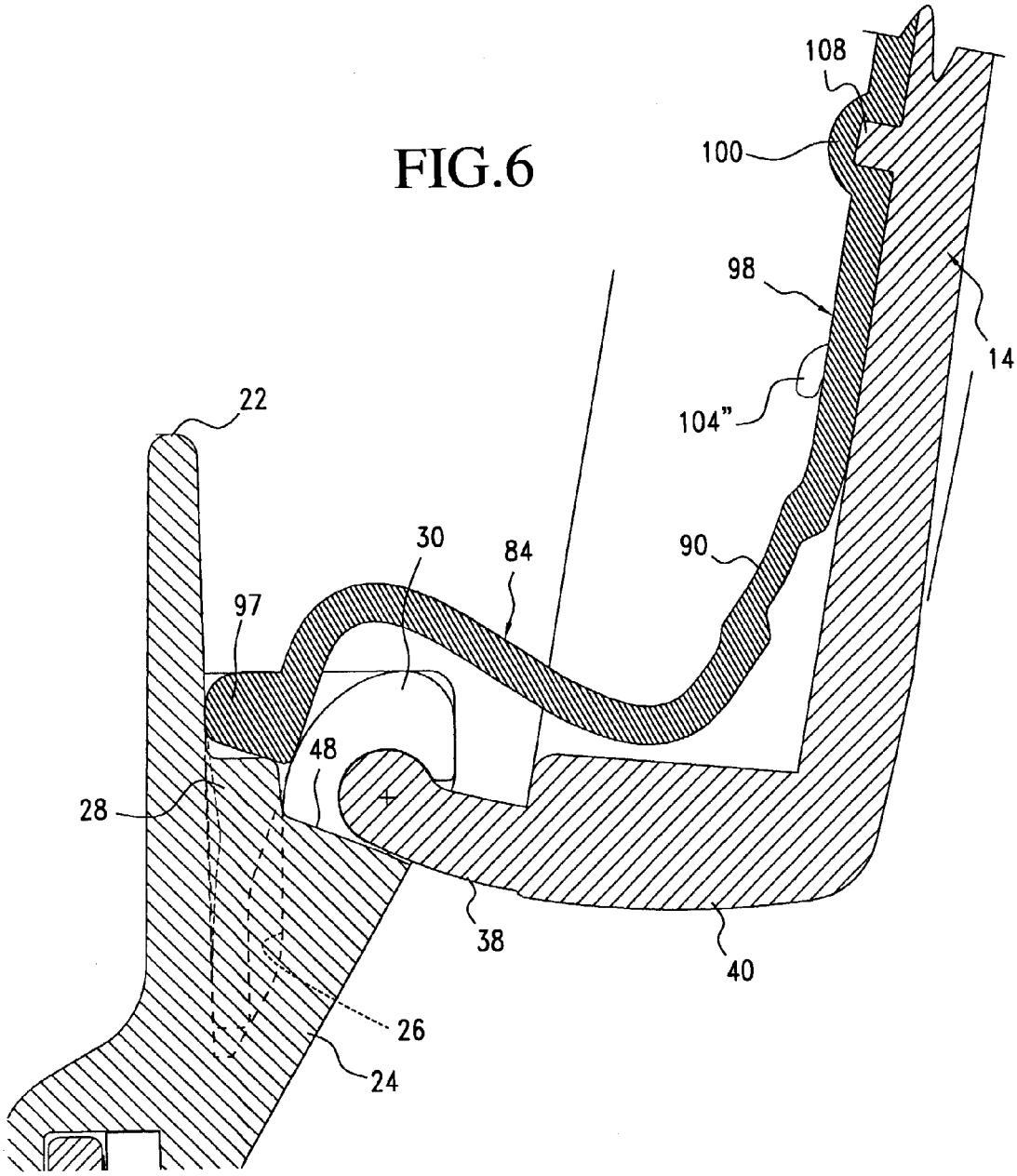
FIG. 6 is an enlarged sectional detail through the container body and open lid at the hinge assembly and with the seal and spring sections mounted in operative position.

The container body 12 includes a peripheral flange 44 at substantially equal height as the hinge knuckles 30 with the flange 44 extending continuously from the rear hinge assembly about the opposed side and front walls of the container body and spaced below the body rim 22 a distance corresponding to the height of the lid skirt 40 for a seated engagement of the lower edge of the lid skirt 40 thereon in the fully closed and latched position of the lid as shall described subsequently. Stabilizing and guiding gussets 46 can be provided between the flange 44 and the adjacent body walls sufficiently inward of the outer peripheral edge of the flange 44 as to fully accommodate the lid skirt thereon. p The maximum open position of the lid 14, as illustrated in FIG. 6, is approximately 100° from the container rim whereby an inherent bias to the open position is maintained once the lid is open. The movement of the lid to this open position is limited by an engagement of the pin supports 36 and 38 with an upper edge surface 48 of the rear body abutment 24.

Retention of the lid 14 in its closed position on the container body 12 is effected by a latch assembly including a retaining slot or keeper 50 in the body flange 44 centrally of the front wall 16, and a spring loaded manually releasable latch 52 integral with the lid 14. The latch 52 is in the form of a push button pivotally mounted, through opposing projecting pins 54, to opposed wall segments 56 integral with the lid skirt 40 and extending slightly laterally inward thereof to align to each side of the keeper opening 50 of the body. In order to accommodate the latch and keeper assembly, it will be noted that the peripheral flange 44 of the body extends forward of the front body wall to a greater distance than the extension of the flange 44 along the side walls. Similarly, the forward portion of the lid and the skirt thereon also extend forward to accommodate the latch assembly forward of the body rim 22.

The latch 52 includes an elongate depending latch stem 58 generally aligned with the axis of the pivot pins 54 and including a forwardly or outwardly directed lower hook end which, in the closed and latched position of the lid, engages under a rearwardly directed shoulder 60 defined by the undersurface of the forwardly projecting portion of the body flange 44 immediately forward of the keeper opening 50. A pair of guide panels 58' act, together with guiding gussets 46, to position lid 14 to thus minimize deformation of the cover. The latch stem is resiliently biased and retained into this position by an integral spring bar 62 forward of the latch stem and engaged with a transverse abutment 64 forward of the latch stem 58. The spring bar 62 has an inherent degree of flexible resiliency whereby upon an inward push on the button-like forwardly facing exterior of the latch 52, the spring bar will flex and accommodate inward movement of the latch to free the latch stem from hooked engagement with the keeper shoulder 60. In order to accommodate this movement and the flexing of the spring bar 62, a slight space 66 is provided between the spring bar 62 and the outer pressure-receiving shell of the latch 52. It will be noted that the actual movement of the latch 52 will be a swinging or pivotal movement about the pivot pins 54. Re-engagement of the latch 52 is automatically effected upon a closing of the lid 14 with the camming surface 68 on the lower hook portion of the latch stem 58 riding against the forward edge of the keeper opening 50. Finally, it will be noted that an integral shield 70 depends from the body flange 44 forward of the keeper opening 50 and extends to each side thereof so as to conceal and prevent accidental release of the latch stem hook portion.

Figure 7:
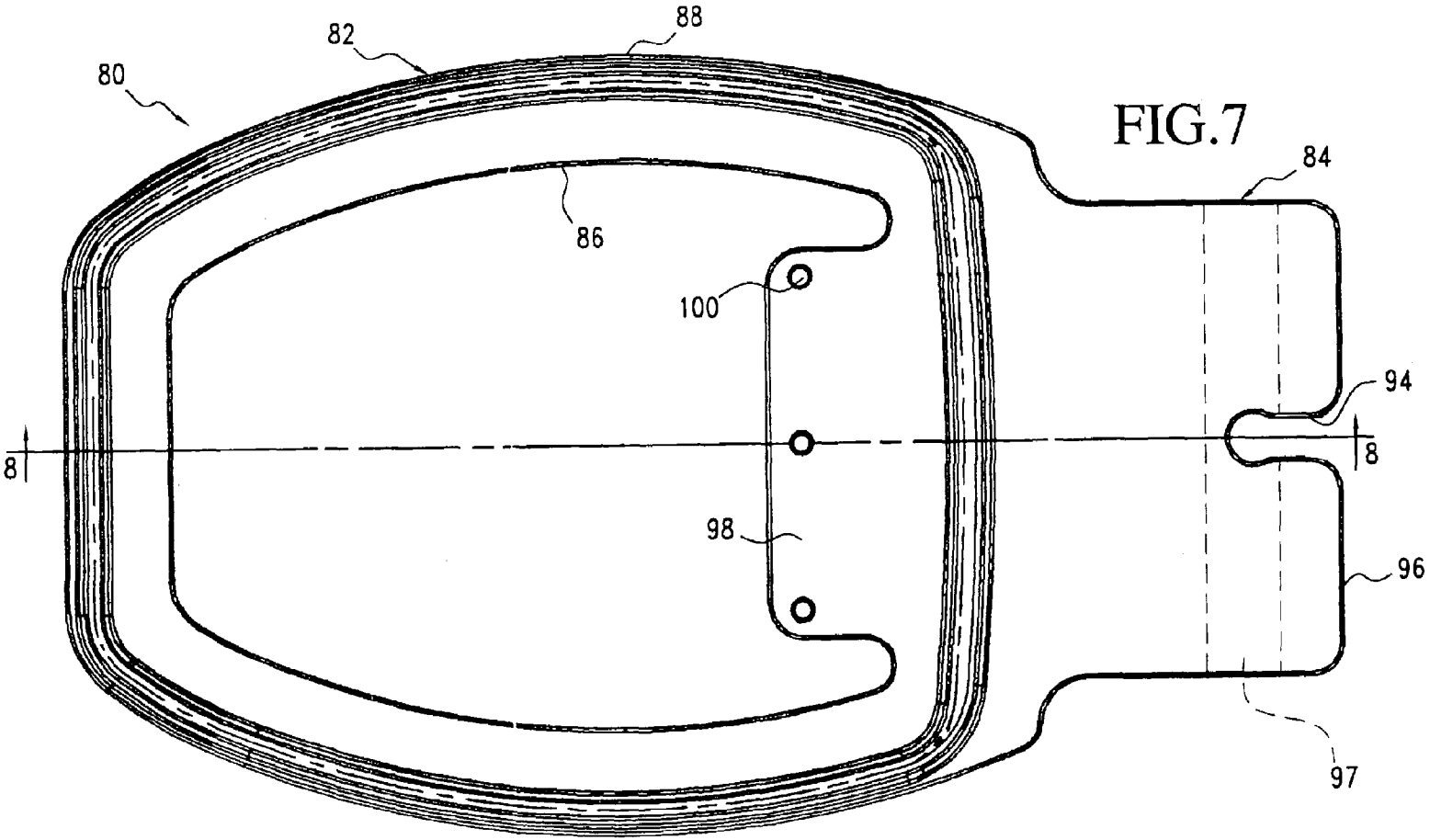
FIG. 7 is an enlarged plan view of the elastomeric member which defines the seal and the spring.
Figure 8:
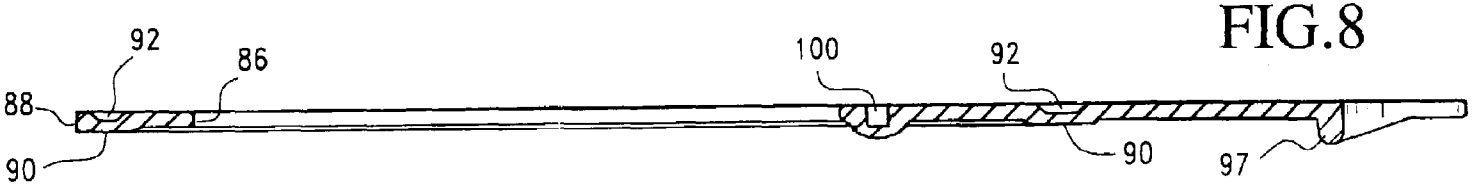
FIG. 8 is a longitudinal cross-section view through the member taken substantially on a plane passing along line 8-8 in FIG. 7.

A combined seal and lid-opening spring is provided uniquely utilizing a single or unitary sheet or panel member 80 formed of an appropriate elastomeric material such as silicone. This member 80, noting in particular FIGS. 7 and 8, is substantially planar and is formed of two sections, a seal or seal section 82 and a spring or spring section 84. The seal 82 is in the nature of a generally flat loop strip conforming to the configuration of the container body rim 22 and including an inner peripheral edge 86 and an outer peripheral edge 88. The seal strip is relatively wider than the body rim 22 and includes, toward the outer periphery 88 thereof, a downwardly offset seal seat 90 which, upon a mounting of the member 80, and a closure of the lid, directly aligns on and with the rim 22 for a compressing of the seal seat 90 by the rim 22 and a positive sealing of the mouth of the container body. The slight depression 92 in the opposed surface of the seal 82, formed by the downward offsetting of the seal seat 90, enhances the flexibility of the seat to ensure a complete and positive sealing action. In addition, the continuous depression 92 about the seal will, upon compression of the seal seat 90, provide for a more positive sealing of the seal to the undersurface of the lid.

The spring or spring portion 84 of the elastomeric member 80 is a generally coplanar extension of that portion of the seal 82 corresponding to the rear wall of the container body. The spring is narrower than the seal and, at the outer portion thereof, includes a positioning slot 94 extending inwardly from the outer edge 96 centrally between the opposed side edges of the spring 84. The spring 84, inward of the positioning slot 94, preferably has a thickened inner end area, or wedge 97, as best illustrated in FIG. 6, which extends transversely of the spring 84, to avoid any tendency for dislodgement of the seal and to provide additional stability in the mounted position as shall be explained subsequently.

The elastomeric member 80 is completed by an integral mounting or anchoring tongue 98 narrower than the spring 84 and extending from the inner peripheral edge 86 of the seal in alignment with the spring 84. The anchoring tongue 98 extends only a minor distance inward of the inner peripheral edge 86 adjacent the spring. The opposed edges of the tongue 98 are inwardly spaced from edge 86 at the opposed sides thereof. The anchoring tongue 98 also includes a plurality, preferably three, of sockets 100 formed therein and opening to the opposite side of the member 80 from the downwardly offset seal seat 90.

Figure 3:
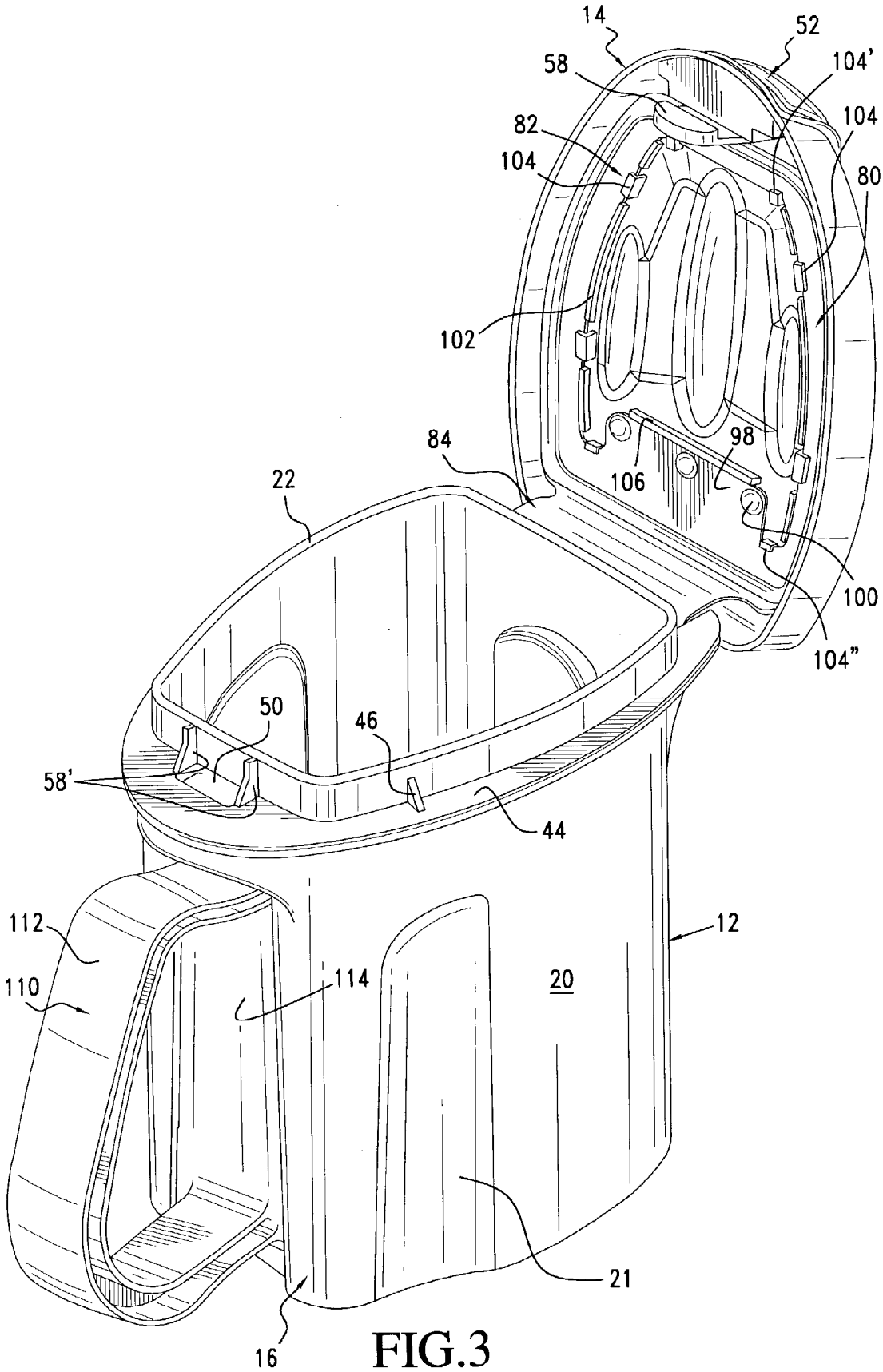
FIG. 3 is a perspective view of the container with the lid fully open.
Figure 4:
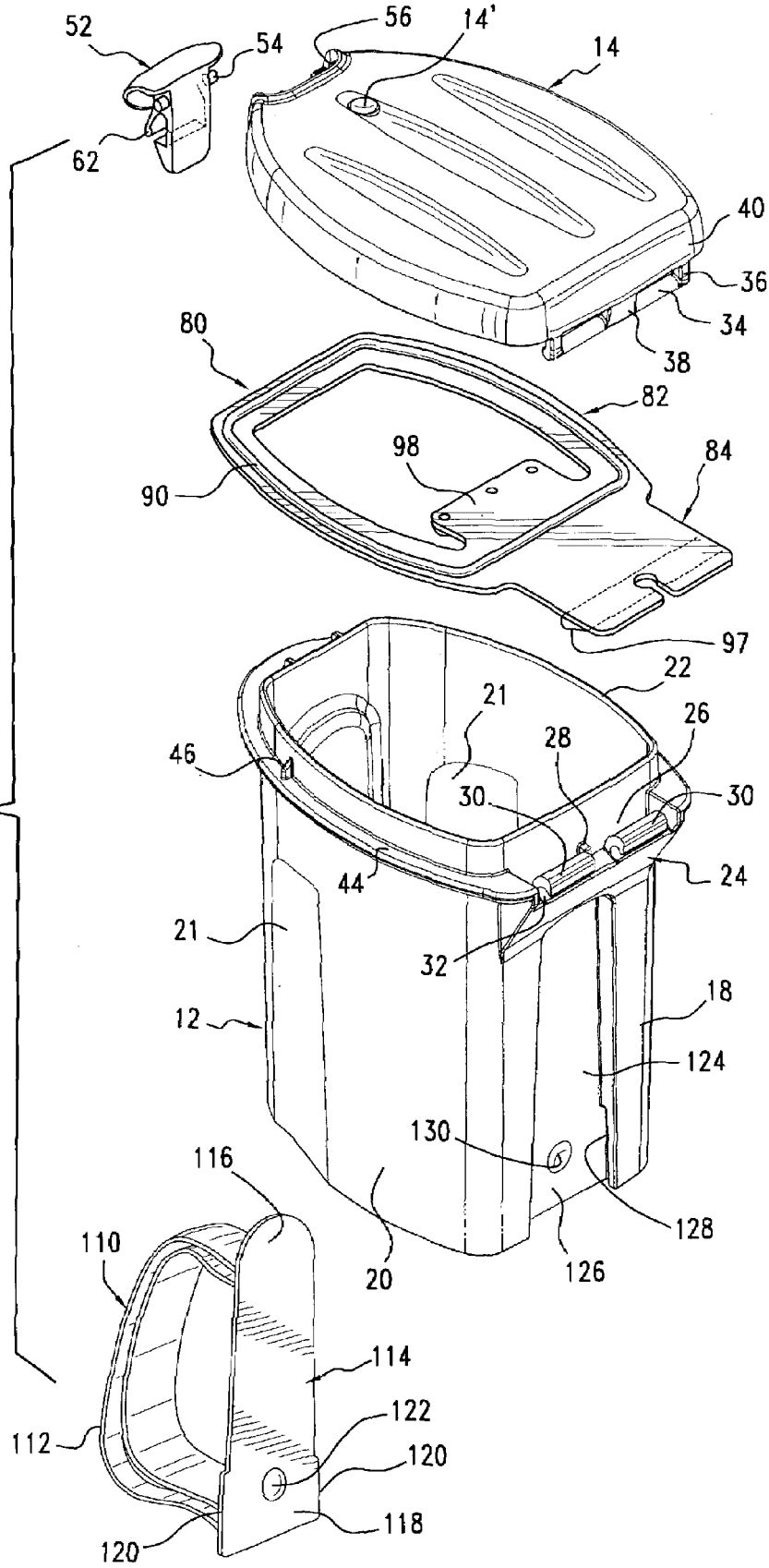
FIG. 4 is an exploded perspective view of the major components of the container.

In order to position the elastomeric member 80 on the lid 14, the bottom surface of the lid is provided with both positioning ribs 102 and retaining lugs 104. Noting FIG. 3 in particular, the ribs are provided as elongate segments with the retaining lugs 104 interposed therebetween. As will be recognized, the ribs and lugs are intended to engage the inner peripheral edge 86 of the seal or seal section 82 of the elastomeric member 80. As such, the ribs and lugs are positioned along the opposed sides of the lid with forward most lugs 104' being forwardly or outwardly directed toward the front or latch end of the lid, and with rearmost lugs 104" being directed toward the hinge end of the lid, thus in effect fixing the longitudinal position of the received seal. The remaining lugs are laterally directed toward the corresponding sides of the lid. As seen in the drawings, the lugs 104 are undercut so as to receive and engage over the inner edge 86 of the seal section 82 for a retention of the seal.

A further positioning rib 106 is provided transversely of the lid parallel to and spaced from the lid hinge assembly and adapted to correspond to the inner edge of the anchoring tongue 98 of the seal section 82. Similarly, a series of anchoring stubs 108 are formed in spaced relation adjacent to the rib 106 and corresponding in number to the anchoring tongue sockets 100 for reception thereof.

In mounting the combined seal and spring, the seal or seal section 82 is positioned against the bottom surface or undersurface of the lid with the flat strip loop of the seal lying thereagainst in a manner whereby the positioning ribs 102 and undercut anchoring lugs 104 engage and both position and retain the inner peripheral edge 86 of the loop. So positioned, the free edge of the anchoring tongue 98 seats against the transverse positioning rib 106 with the seal to the opposite sides of the anchoring tongue being particularly retained by the anchoring lugs 104". The anchoring tongue is further and firmly anchored to the undersurface of the lid by an engagement of the lid stubs 108 within the formed elastomeric sockets 100 on the anchoring tongue 98. When so mounted, the downwardly offset seal seat 90 is in direct alignment with the container body rim 22 for a sealed seating engagement therewith upon a closure of the lid.

The mounting of the spring or spring section 84, noting FIG. 6, involves a flexing of this spring section, with the lid pivoted fully open for easy access thereto, over the hinge assembly and into the pocket 26 with the positioning slot 94 receiving the divider 28 therein. Such a positioning of the spring requires a resilient compressing, or what might be considered a pre-compressing, of the spring in the open position of the lid 14. It is this pre-compressing which effectively retains the lid in its fully open position. As will be appreciated from the above described mounting of the elastomeric member, the member, while highly effective when mounted for both its intended sealing and spring functions, is easily removed for cleaning or replacement as desired.

Figure 9:
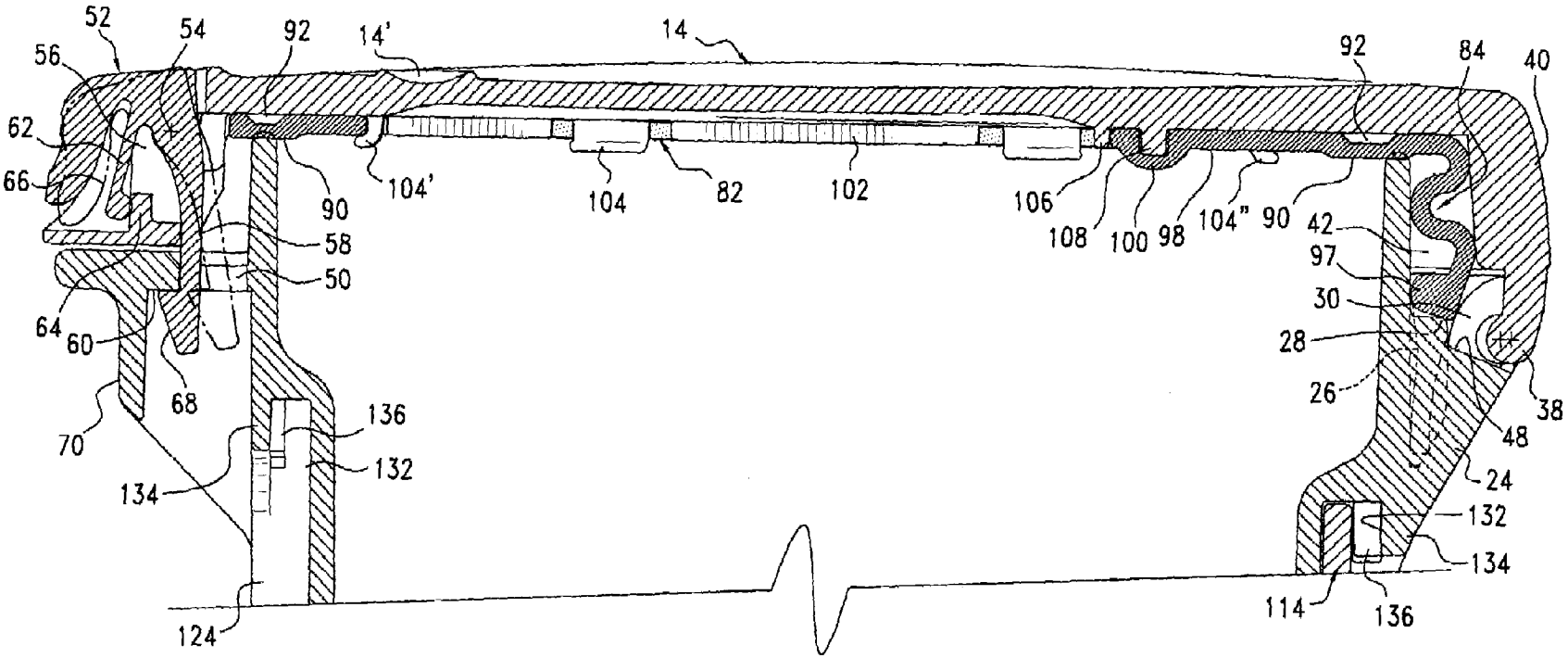
FIG. 9 is an enlarged cross-section detail through the upper portion of the closed container.
Figure 10:
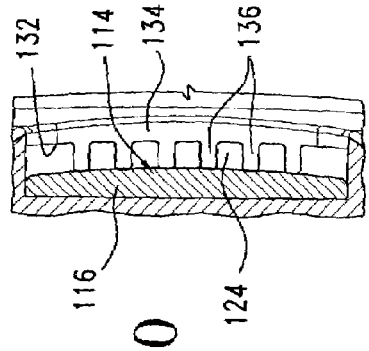
FIG. 10 is an enlarged cross-section detail taken substantially on a plane passing along line 10-10 in FIG. 5.

Noting FIG. 9 in particular, upon a closing of the lid 14 to its latched position, whereat the container body rim 22 intimately engages with the seal seat 90, the spring 84 folds rather neatly within the chamber 42 defined above the divided pocket 26 and between the lid skirt 40 and the wall of the body immediately below the rim 22. This action effects a further and rather substantial resilient compressing of the spring which in turn provides a substantial biasing force retained only by the latch mechanism. Thus, upon a release of the latch mechanism the lid will, through the action of the heavily compressed spring, rapidly move to its fully open position, and be retained therein by the remaining biasing force of the still compressed spring produced by the initial mounting of the elastomeric member. It will be appreciated that the relationship between the engaged position of the latch and the seal is such as to sufficiently compress the seal against the container body rim as to effect the desired sealing action.

The positioning slot 94 in the spring, in addition to properly positioning the spring within the container body pocket 26, assists in a positive retention of the spring whereby any tendency for the spring to displace from the pocket is specifically precluded. As noted in FIG. 6 in particular, the enlargement or wedge-shaped protuberance 97 which is preferably provided adjacent the inner end of the slot will enhance this retention capability. Incidentally, it will also be noted that the spring section 84 overlies the hinge assembly in both the closed and open position of the container lid, providing in effect a protective shield for the hinge assembly.

The present invention also provides for an alternate positioning of the container handle 110 so as to accommodate the preferences of the ultimate user. In other words, the handle can mount vertically to the front wall 16 of the container in alignment below the latch assembly whereby the user can both grip the handle and manipulate the latch with a single hand. Alternatively, provision is also made for a mounting of the handle to the rear wall 18 of the container body, in which case, one hand will hold the handle, and the other hand will release the latch mechanism. Such a positioning of the handle will also allow for a convenient discharge of the contents from the front of the container. Both positionings of the handle have specific advantages which are available at the option of the user, the handle itself being readily removed and repositioned. At the same time, when mounted, the handle is firmly and rigidly affixed to the container against any possibility of accidental release therefrom. More specifically, the handle 110, in addition to the handgrip loop 112, includes a rigid flat mounting bar or plate 114 with opposed vertical edges which taper slightly upward from the lower end thereof and which extends slightly above the grip 112 to provide a projecting upper end or vertical extension 116. The lower end portion 118 of the mounting plate 114 is slightly wider than the plate thereabove, providing a pair of narrow laterally projecting edge extensions or wing portions 120. This lower end portion 118 also includes a central rounded knob 122 projecting outward of the plane of the plate 114 to the opposite side thereof from the handgrip 112.

The front and rear walls of the container body include substantially duplicate vertical slots 124 therein, each slot narrowing upward from the open lower end thereof corresponding to the taper of the handle mounting plate 114. The side edges of the slot 24, at the lower end portion 126 thereof, are undercut or grooved as at 128 to accommodate the laterally projecting wings 120 of the corresponding lower portion 118 of the mounting plate 114. Thus, with the lower portion 118 of the mounting plate positioned immediately below the undercut lower portion 126 of the slot 124, at the open lower end of the slot, the handle can be introduced laterally into the slot and shifted slightly upward to engage the plate side edge extensions 120 within the undercuts or grooves 128 of the mounting slot 124. There is no need to slide the full length of the handle mounting plate 114 the full length of the corresponding receiving slot 124.

Upon a full seating of the handle mounting plate 114 in the corresponding slot or groove 124, the knob or projection 122 snap locks into a complementary recess 130 in the inner wall of the handle receiving slot 124 as a means for firmly although releasably retaining the handle on the container body.

The upper projecting planar portion 116 of the mounting plate 114 of the handle is in turn received within a downwardly opening pocket 132 at the upper end of each of the front and rear handle slots 124. The pocket is defined by the inner wall of the slot 124 itself and a parallel short depending outer wall segment 134 which is actually an integral continuation of the respective front and rear container body walls. In order to provide for a snug although releasable reception of the mounting plate extension 116, the outer wall segment 134, in each slot 124, includes a series of spaced vertical ribs 136 facing toward the interior of the pocket. In this manner, a firm retention of the upper portion 116 is provided without any tendency for a jamming or permanent locking of the handle. When fully seated, the mounting plate upper extension 116 will preferably engage the inner end of the pocket 132 simultaneously with the engagement of the knob or protuberance 122 within the slot recess 130.

In order to remove the handle from the slot, the handle need merely be forcibly shifted downward a distance only sufficient so as to vertically retract both the upper mounting plate extension 116 from the corresponding pocket and the lower mounting plate enlargement 118, and more particularly the opposed side extensions 120 thereof, from the receiving grooves 128 on the lower portions of the side walls of the slot 124. The handle can then be laterally removed from the container without requiring a longitudinal sliding or withdrawal of the mounting plate along the full height of the slot 124. Utilizing receiving grooves 128 only at the lower section of the slot 124, in conjunction with the upper slot pocket 132, while providing for a firm retention of the handle, does so in a manner which greatly facilitates both a mounting and removal of the handle, and avoids any tendency for the mounting plate to jam within the corresponding slot 124 such as might be the case where the locking grooves 128 to extend the full height of the slot 124 and the mounting plate 114 being required to slidably engage therein along the full height of the plate receiving slot 124.

The mounting of the handle to the front or rear wall of the container body will be in accord with the wishes of the user of the container with the handle being repositionable as desired. When mounted to the front wall, a single hand can be used to both grasp the handle and release the latch. With the handle mounted to the rear wall, release of the latch will normally be by the second hand of the user. This latter arrangement may be preferred by those with a particular lack of manual dexterity whereby one cannot, with a single hand, hold both the container and manipulate the latch. Other factors which may enter into handle positioning include the nature of the contents of the container, and the manner in which the contents are to be accessed.

The foregoing is illustrative of the principles of the invention, and while a specific embodiment of the invention has been set forth in detail, it is to be appreciated that variations may occur to those skilled in the art, such as dimensional changes resulting in both larger and smaller containers, and containers of shapes other than the basic oval shape illustrated, all without departing from the spirit and scope of the invention as set forth in the following claims.

The invention claimed is:

1. A container comprising a container body and lid therefor; said body having a rim defining a mouth opening into the interior of said body, pivot means engaged with and between said body and said lid for pivotal movement of said lid between a closed position overlying and closing said mouth and an open position pivoted outward away from said mouth, said lid having a bottom surface, an elastomeric member positioned between said lid and said body, said member including a generally planar seal section affixed to said lid bottom surface, and, in said closed position, being coextensive with and engaging on said rim, said member also including a spring section integral with and extending outward of said seal section, said spring section including an outer portion remote from said seal section and engaged with said container body adjacent said pivot means, said spring section, in said closed position of said lid, being compressed and exerting a biasing force biasing said lid to said open position, and latch means engaged between said lid and said container body to releasably retain said lid in said closed position against the biasing force of said spring section.

2. The container of claim 1 wherein said spring section, in said open position, is compressed to a lesser degree than in said closed position and maintains a continuing biasing force on said lid in said open position.

3. The container of claim 2 wherein said seal section is generally of a loop configuration corresponding to the configuration of the rim, said loop configuration including an inner peripheral edge and an outer peripheral edge, retaining means on said bottom surface of said lid engaging and releasably affixing said seal section to said lid bottom surface.

4. The container of claim 3 wherein said seal section, continuously about said loop configuration, includes a seal seat defined therefrom, said seal seat comprising a continuous downward offset in said seal section of said elastomeric member of a continuous width sufficient to receive said rim in engagement therewith upon a moving of the lid to said closed position.

5. The container of claim 3 wherein said retaining means on said bottom surface of said lid comprises spaced depending undercut lugs which engage about one of said peripheral edges of said loop configuration.

6. The container of claim 5 wherein said container body includes a pocket defined therein releasably receiving and retaining said outer portion of said spring section, said pocket being downwardly offset from said rim and opening upwardly relative thereto.

7. The container of claim 6 wherein said pocket includes a vertical central divider, said outer portion of said spring section including a central slot extending inwardly thereof and receiving said divider therein upon introduction of said spring into said pocket.

8. The container of claim 6 including a chamber formed between said body and said lid above and as a continuation of said pocket in said closed position of said lid, said spring section, upon a movement of said lid to said closed position, compressing and folding into said chamber.

9. The container of claim 8 including an anchoring tongue defined in said elastomeric member and extending inwardly of said seal section loop configuration in alignment with said spring section, and means releasably affixing said anchoring tongue to said lid for stabilization of said elastomeric member during compression of said spring section.

10. The container of claim 9 wherein the means affixing said anchoring tongue includes projecting stubs extending from said lid bottom surface and sockets integrally defined in said anchoring tongue and resiliently engaging over said stubs.

11. The container of claim 10 including a selectively positioned container handle, said handle including an elongate mounting plate, said container body having a plurality of receiving slots for said mounting plate, one of said slots generally aligning with said latch means, and a second of said slots remote therefrom.

12. The container of claim 11 wherein said handle, in addition to said mounting plate, includes a handgrip, said mounting plate including a vertical extension above said handgrip, said mounting plate further including a lower section of a greater lateral width than the remainder of said mounting plate thereabove, said greater lateral width defining a pair of opposed edge extensions, each of said mounting plate receiving slots including a downwardly directed pocket at the upper end thereof receiving said vertical extension of said mounting plate, and a pair of grooves at the lower end portion of said slot of a length equal to the height of the mounting plate edge extensions for reception of said extensions therein.

13. The container of claim 1 wherein said latch means comprises a keeper slot with latching shoulder in said container body, a latch stem mounted on said lid and aligned to engage with said keeper slot latching shoulder upon closure of said lid, and means selectively moving said latch stem for disengagement from said shoulder for release of said lid to allow opening biasing of said lid relative to said container body.

14. The container of claim 1 including a selectively positionable container handle, said handle including an elongate mounting plate, said container body having a plurality of receiving slots for said mounting plate, one of said slots generally aligning with said latch means, and a second of said slots remote therefrom.

15. The container of claim 14 wherein said handle, in addition to said mounting plate, includes a handgrip, said mounting plate including a vertical extension above said handgrip, said mounting plate further including a lower section of a greater lateral width than the remainder of said mounting plate thereabove, said greater lateral width defining a pair of opposed edge extensions, each of said mounting plate receiving slots including a downwardly directed pocket at the upper end thereof receiving said vertical extension of said mounting plate, and a pair of grooves at the lower end portion of said slot of a length equal to the height of the mounting plate edge extensions for reception of said edge extensions therein.

16. The container of claim 15 wherein said mounting plate at said lower section thereof, and each of said mounting plate receiving slots, at a corresponding location therein, include releasable locking means comprising a projecting knob and a complementary recess which engage upon a full seating of said mounting plate within the slot.

17. The container of claim 2 wherein said elastomeric member is selectively removable from said lid and said body, and, when removed, is of a substantially planar configuration, said spring section being compressed upon positioning of said elastomeric member between said lid and said body.

* * * * *